US007020422B2

(12) United States Patent
Tsuruya et al.

(10) Patent No.: US 7,020,422 B2
(45) Date of Patent: Mar. 28, 2006

(54) TRANSFERRING ROLLER, TRANSFER DEVICE, AND IMAGE FORMING APPARATUS

(75) Inventors: Takaaki Tsuruya, Shizuoka (JP); Yoshiro Saito, Shizuoka (JP); Shunichi Ebihara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 531 days.

(21) Appl. No.: 10/280,014

(22) Filed: Oct. 25, 2002

(65) Prior Publication Data

US 2003/0081226 A1 May 1, 2003

(30) Foreign Application Priority Data

Oct. 29, 2001 (JP) ..... 2001-331369

(51) Int. Cl.
*G03G 15/20* (2006.01)

(52) U.S. Cl. ..... 399/313
(58) Field of Classification Search ..... 358/1.6; 399/308, 313, 314, 121, 302
See application file for complete search history.

(56) References Cited

U.S. PATENT DOCUMENTS

| | | | | |
|---|---|---|---|---|
| 5,809,387 | A | 9/1998 | Takeuchi et al. | 399/302 |
| 6,041,209 | A * | 3/2000 | Murata | 399/313 |
| 6,078,775 | A * | 6/2000 | Arai et al. | 399/308 |
| 6,308,019 | B1 | 10/2001 | Miyashiro et al. | 399/66 |
| 6,477,339 | B1 * | 11/2002 | Yano et al. | 399/66 |
| 2001/0021736 | A1 * | 9/2001 | Murata | 524/190 |
| 2002/0006294 | A1 * | 1/2002 | Yano | 399/310 |
| 2003/0104295 | A1 * | 6/2003 | Niimi | 430/59.4 |

FOREIGN PATENT DOCUMENTS

| | | | |
|---|---|---|---|
| JP | 09269679 | A * | 10/1997 |
| JP | 11030897 | A * | 2/1999 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member, and a transfer member, wherein an image on the image bearing member is transferred to a member to be transferred by applying a voltage to the transfer member, and wherein the transfer member has an ion conductor part having an antioxidant. Variation in resistivity accompanying a change in applied voltage is thereby reduced, whereby sufficiently high transferring efficiency can be maintained during a durability test.

30 Claims, 6 Drawing Sheets

TRANSFERRING ROLLER, TRANSFER DEVICE, AND IMAGE FORMING APPARATUS

BACKGROUND OF THE INVENTION

1. Field of the Invention

The present invention relates to an image forming apparatus such as a printer, a copying machine, or a facsimile machine, and more particularly, to a transfer device (apparatus) and a transfer member used in the image forming apparatus.

2. Related Background Art

In recent years, the development of image forming apparatuses such as printers, copying machines, and facsimile machines capable of operating at higher speed, having an increased number of functions and capable of forming images in an increased number of colors has progressed. Such image forming apparatuses heretofore proposed use various image forming systems. Among them, inline-type image forming apparatuses in which image forming means using a plurality of different colors are arranged in a row to successively transfer toner images directly onto a belt or onto a transfer material born by a transferring belt in a multiple transfer manner such that toner images are superposed one on another are considered to go mainstream as a color image forming apparatus in future because they have high operating speed and are capable of forming a multicolor image.

Inline-type image forming apparatuses are divided into a type (intermediate transfer type) in which toner images are temporarily transferred onto an intermediate transfer member in a multiple transfer manner and are thereafter transferred to a transfer material, and another type (transferring belt type) in which a transfer material is attracted to a transferring belt and multiple transfer is performed directly on this transfer material. From the viewpoint of reducing the size and manufacturing cost of the apparatus, it can be said that apparatuses of the latter type having a smaller number of system constituent elements are more advantageous.

Transferring belt type image forming apparatuses require a process in which, in the case of four-full-color image forming, transfer to an object such as a transfer material (e.g., paper or a transparent resin film) or a transferring belt having an instability factor with respect to the resistance value is performed four times and therefore have the disadvantage of being not sufficiently stable with respect to the kind of transfer material and conditions in environments where they are installed. Also, they require a considerably high transferring voltage for causing a sufficiently large transfer current at the time of automatic double-side image forming including repeating an image forming operation on a transfer material after the resistance of the transfer material has been increased by evaporation of water added at the time of fixation previously performed, or in an overhead transparency (OHT) mode in which image forming is performed on a transparent resin film which is insulating in the thickness direction.

Also, transfer-belt-type image forming apparatuses have four image forming stations (hereinafter referred to briefly as "station") arranged between a position on the upstream side in the transfer material conveyance direction and a position on the downstream side in this direction. When the stations perform transfer successively from the upstream side, the transfer material or the transferring belt is charged up by receiving transfer charge, so that the transferring voltage required by the stations is increased with the distance from the upstream end position.

In a transferring part, discharge is caused between a photosensitive drum, a transfer material, a transferring belt, and a transfer member, e.g., (a transferring roller) to effect toner transfer and to move charge to the transfer material. If the transferring voltage is excessively high, excessive discharge or abnormal discharge occurs between the members, to which the high voltage is applied, resulting in failure to suitably transfer toner. In particular, if a leak site or the like exists between the transfer member and the transferring belt, discharge is concentrated at the leak site to cause deterioration in transferring performance.

Further, in a reversal developing system, variation in potential contrast between a dark portion potential and a light portion potential on an organic photo-conductive (OPC) material as seen from a transfer member leads to a change in amount of charge given to the OPC. A dark portion potential portion having a high transfer contrast is given transfer charge of a polarity opposite to that of the OPC charge potential, so that charging failure due to limitation of the increase in OPC potential at the time of subsequent image forming or OPC ghost is liable to occur frequently.

To ensure sufficiently high conductivity of a transferring roller, an electron-conductive filler such as carbon black or a metal oxide may be dispersed in a material for the transferring roller. In such a case, however, local resistance nonuniformity can occur easily due to nonuniformity of dispersion of the filler. In particular, a portion where the filler condenses becomes a leak site, at which a current is concentrated and can flow easily if the transferring voltage is high. The conduction mechanism in an electron-conductive material is such that electrons move between filler particles while hopping by the tunnel effect, and the current can be abruptly caused to flow readily and the resistance value becomes small when the applied voltage is increased.

To solve this problem, a method has been proposed in which an ion-conductive material whose resistance with respect to the applied voltage is comparatively stable and which has reduced local resistance nonuniformity is used to form a transfer member.

FIG. 4 shows voltage dependence of the resistance of an electronic conductor type of transferring roller and the resistance of an ionic conductor type of transferring roller adjusted so as to be equal to each other when the applied voltage is 500 V. In the region above 500 V, the resistance of the electronic conductor type of roller is lower than that of the ionic conductor type of roller. FIG. 5 shows the transfer efficiencies in uses of the two types of transferring rollers. It can be understood from FIG. 5 that the region through which the transferring efficiency is sufficiently high is narrow in the case of the electronic conductor type roller, while that in the case of the ionic conductor type roller is wider.

Generally, the transferring efficiency is improved if the transferring voltage (transferring bias) is increased. However, the electronic conductor type roller has a larger resistance value when the transferring voltage is low (e.g., lower than 500 V indicated in FIG. 4) and therefore the rate of increase in transferring efficiency in the case of use of the electronic conductor type roller is lower than that in the case of use of the ionic conductor type roller. That is, the transferring efficiency is peaked at a lower transferring voltage in the case of the ionic conductor type roller. If the transferring potential is excessively high, a toner transfer failure due to abnormal discharge or the like occurs and transferring efficiency decreases. Under such a condition, the reduction in transferring efficiency in the case of electronic conductor type roller starts before that in the case of the ionic conductor type roller. Since the electronic conductor type roller has a leak site due to resistance nonuniformity, it is thought that the transferring voltage at which abnormal discharge starts in the electronic conductor type roller is lower than the transferring voltage at which abnormal discharge starts in the ionic conductor type roller.

The ionic conductor type roller has a linear current-voltage characteristic as shown in FIG. 4 and is, therefore, substantially free from the problem relating to a high-transfer-contrast dark portion potential and the problem that an excessively large amount of current flows through a small-size non-paper-passing portion. Therefore, if this type of transferring roller is used in a reversal developing system, OPC ghost and charging failure do not occur easily.

With the ionic conductor type of transferring roller having the advantage that variation in resistance with respect to the applied voltage is small and that local resistance nonuniformity is also low, there arises a problem in that the resistance increases about ten times higher (at a rate of about one digit of magnitude in terms of common logarithm) to cause a reduction in transferring efficiency by a paper feeding durability test which is performed by feeding many paper (hereinafter referred to as "durability test"). FIG. 2 shows the transferring efficiency of an ionic conductor type of transferring roller before a durability test (in an initial state) and the transferring efficiency after the durability test (after its characteristics had been changed by the durability test). The high-transferring-efficiency region of the transferring roller after the durability test was reduced in comparison with that before the durability test. This transferring roller was tested after grinding away a roller surface portion by a thickness of about 500 μm therefrom. The result showed that the same resistivity characteristic as that before the durability test was again exhibited and the transferring efficiency was also improved. From this result, it can be thought that the transferring roller surface portion deteriorated by discharge or the like after the durability test to increase the resistance, and that, in a region of a lower transferring voltage, the rate of increase in transferring efficiency was reduced due to the increase in resistance. With respect to the observed increase in roller surface potion resistance, it is proper to think that not the uniform formation of a high-resistance layer but resistance nonuniformity occurred, and that abnormal discharge occurred earlier in a region of a higher transferring voltage to cause deterioration in transferring efficiency in comparison with the state before the durability test.

SUMMARY OF THE INVENTION

An object of the present invention is to provide an image forming apparatus, a transfer device and a transferring roller in which it is possible that a change in resistance due to a change in applied voltage is limited and transferring efficiency after a durability test is sufficiently high.

Another object of the present invention is to provide an image forming apparatus including an image bearing member and a transfer member, wherein an image on the image bearing member is transferred to a member to be transferred by applying a voltage to the transfer member, and the transfer member has an ionic conductor part which contains an antioxidant.

Further another object of the present invention is to provide a transfer device including a transfer member and a voltage applying means, wherein the voltage applying means applies a voltage to the transfer member and an image is transferred to a member to be transferred, and the transfer member has an ionic conductor part which contains an antioxidant.

Still further object of the present invention is to provide a transferring roller including a metal core and an ionic conductor part provided on the metal core, wherein the ionic conductor part contains an antioxidant.

These and other objects and features of the present invention will become apparent from the following detailed description of preferred embodiments of the invention.

DESCRIPTION OF THE PREFERRED EMBODIMENTS

Figure 1:
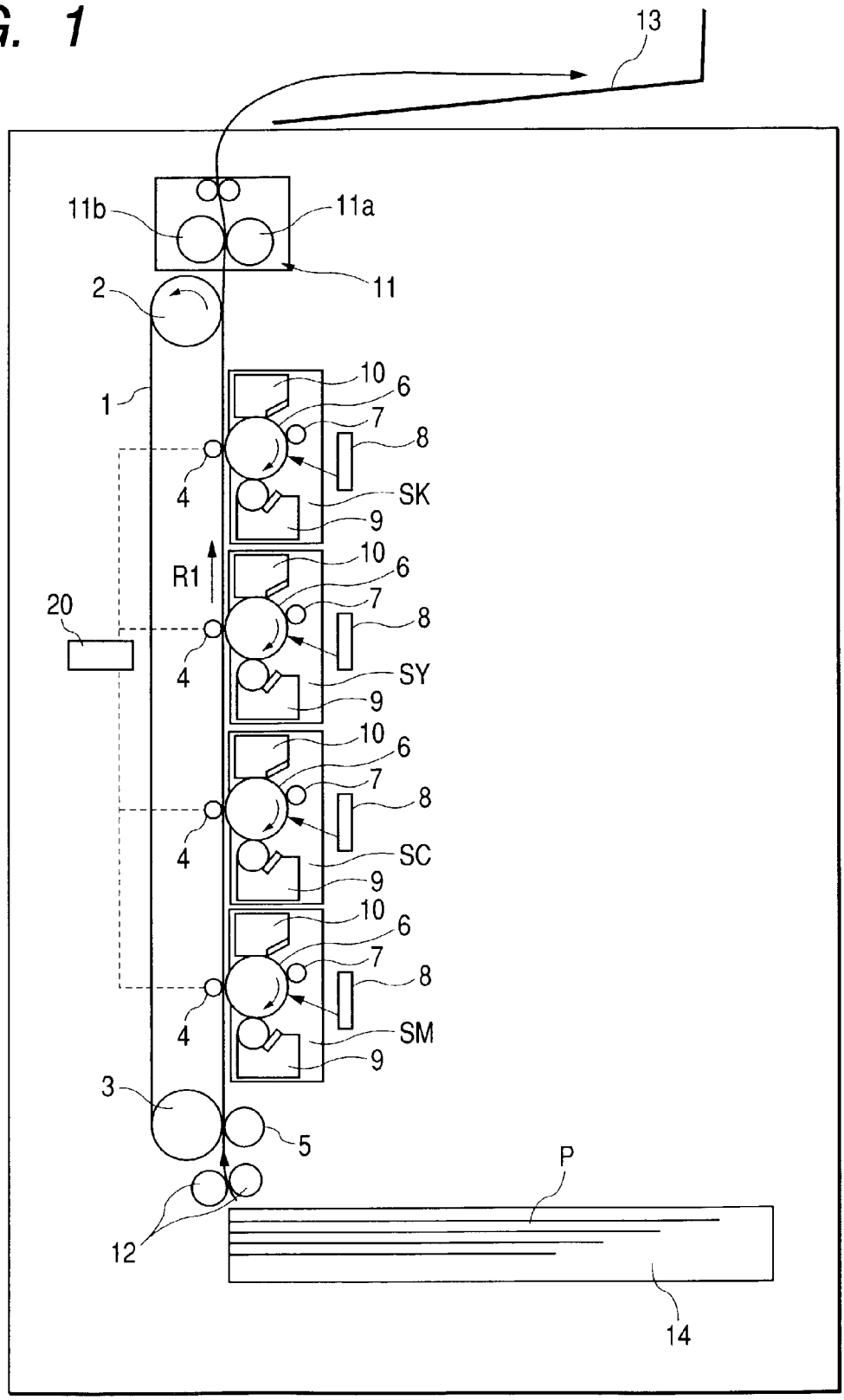
FIG. 1 is a diagram showing an image forming apparatus, which represents an embodiment of the present invention.

Embodiments of the present invention will be described with reference to the accompanying drawings. The same reference numerals in the drawings indicate the same components or functions, and the description for the same components or functions will not be repeated.

First Embodiment

FIG. 1 shows an example of an image forming apparatus according to the present invention. The image forming apparatus shown in FIG. 1 is a four-full-color laser printer based on an electrophotographic system and having four image forming stations for forming toner images in different colors. FIG. 1 is a longitudinal sectional view schematically showing the construction of this laser printer.

The schematic construction of the laser printer (hereinafter referred to as "image forming apparatus") will be described with reference to FIG. 1.

The image forming apparatus shown in FIG. 1 has an endless transferring belt 1 provided as a transferring and conveying member. The transferring belt 1 is stretched between a drive roller 2 and a driven roller 3. With the rotation of the drive roller 2 in the direction of an arrow indicated in the figure, the transferring belt 1 moves in the direction of arrow R1.

A sheet-feeding cassette 14 in which a transfer material (recording material) P provided as the other member (a member to be transferred) for image forming (printing) is accommodated is provided in a lower section of the image forming apparatus. As transfer material P, plain paper, thin paper, carton, an envelop, an OHT sheet (transparent resin film for use in an overhead projector), etc., may be used.

A registration roller 12 for feeding transfer material P at predetermined timing and an attraction roller 5 for attracting transfer material P to the surface of the transferring belt 1 are provided above a left end of the sheet-feeding cassette 14 as viewed in FIG. 1. Four image forming stations SM, SC, SY, and SK are arranged in line from a upstream position to a downstream position along the direction of transport of transfer material P (the direction of movement of the transferring belt 1) (from a lower position to an upper position as viewed in FIG. 1). This arrangement will be referred to as "in-line system" on occasions. These image forming stations SM, SC, SY, and SK form toner images in this order, i.e., magenta (M), cyan (C), yellow (Y), and black (K) toner images.

The image forming stations SM, SC, SY, and SK are substantially identical to each other in construction and each have a photosensitive drum 6 provided as an image bearing member, a charging roller (primary charger) 7 for uniformly charging the surface of the photosensitive drum 6, an exposure device 8 for exposing the surface of the photosensitive drum 6 after charging to form an electrostatic latent image, a developing device 9 for attaching toner to the electrostatic latent image to develop a toner image, a transferring roller (transfer member) 4 for transferring the toner image on the photosensitive drum 6 to the transfer material P, and a cleaning device 10 for cleaning the surface of the photosensitive drum 6 after toner image transfer.

A fixing device 11 for fixing the toner image transferred to transfer material P and a sheet-discharge tray 13 onto which transfer material P after toner image fixing is discharged are provided above the image forming station SK on the most downstream side of the arrangement of the stations.

The operation of the above-described image forming apparatus will be described as well as details of each of the above-described members, devices, etc.

The photosensitive drum 6 is an electrophotographic photosensitive member formed into the shape of a drum, and has a photosensitive layer formed on the surface of a cylindrical electroconductive base member. For example, OPC or amorphous silicon can be used to form the photosensitive layer. The photosensitive drum 6 is driven to rotate in the direction of the arrow at a predetermined process speed (peripheral speed) by a drive means (not shown).

The photosensitive drum 6 driven and rotated in the direction of the arrow has its surface uniformly charged at a predetermined potential with a predetermined polarity by means of the charging roller 7.

On the surface of each photosensitive drum 6 after changing, an electrostatic latent image is formed by each exposure device 8. The exposure device 8 includes of a laser diode, a polygon scanner, a lens group, and a reflecting mirror (not shown). The exposure device 8 selectively exposes the photosensitive drum 6 surface to the laser beam on the basis of image information to form an electrostatic latent image corresponding to the image information.

The electrostatic latent image formed on the surface of each photosensitive drum 6 in this manner is developed by the developing device 9. In the developing devices 9, magenta, cyan, yellow and black developers (toners) are respectively contained. Each of these color toners is attached to the electrostatic latent image on the corresponding photosensitive drum 6 by means of a developing sleeve placed so as to face the photosensitive drum 6. The electrostatic latent image on each photosensitive drum 6 is thereby developed as a toner image in each of the colors, i.e., magenta, cyan, yellow and black. Each of the above-mentioned color toners is nonmagnetic toner including no magnetic material. Each toner is attached to the electrostatic latent image by a one-component contact developing method. In this embodiment, image forming is performed, typically, by using a reversal developing method in which a negatively charged toner is used, a dark portion potential of −700 V and a developing potential of −400 V are set, and transfer is performed by using a positive transferring bias.

The transferring belt 1 is stretched between the drive roller 2 and the driven roller 3. With the rotation of the drive roller 2 in the direction of the arrow, the transferring belt 1 is driven to rotate in the direction of arrow R1 at the same peripheral speed as the photosensitive drum 6. Transfer material P fed from the sheet-feeding cassette 14 by a feed roller (not shown) passes the registration roller 12 and then passes the nip between the transferring belt 1 and the attraction roller 5 to be attached to the surface (outer peripheral surface) of the transferring belt 1 by being electrostatically attracted to the same.

The attraction roller 5 has a metal core having a diameter of 6 mm and a solid rubber portion molded on the metal core. With this construction, a high bias voltage can be applied to the metal core. In this case, the attraction roller 5 is a solid rubber roller having a diameter of 12 mm and having EPDM rubber in which carbon black is dispersed for resistivity adjustment. A strip of metallic foil having a width of 1 cm is wrapped around the outer peripheral surface of the roller to adjust the resistivity so that the resistance is $1\times10^5$ Ω when a voltage of 500 V is applied between the surface and the metal core. An attraction bias is generated from a high-voltage substrate according to a signal determined by a DC controller (not shown) according to an environment in which the image forming apparatus is used and image forming conditions (printing conditions). The attraction voltage and current can be monitored through an A/D converter (not shown) on the high-voltage substrate.

Each transferring roller 4 is placed inside the transferring belt 1 at such a position as to face the photosensitive drum 6 and to pressurize the back surface of the transferring belt 1 so that the surface of the transferring belt 1 contacts the photosensitive drum 6. Each time transfer material P attached to the transferring belt 1 passes one of the image forming stations SM, SC, SY, and SK, a transferring bias is applied to the transferring roller 4 from a power supply 20 which is a voltage application means. The toner images on the photosensitive drums 6 are thereby transferred successively to the surface. Thus, the toner images in the four colors are superposed one another on transfer material P.

After the toner images have been transferred to transfer material P, transfer material P is separated from the surface of the transferring belt 1 by the curvature effect in the vicinity of the drive roller 2 on the most downstream side of the transferring belt 1, and is thereafter fed into the fixing device 11. On the other hand, from the photosensitive drum 6 after toner image fixation, toner (residual toner) left on the surface without being transferred to transfer material P at the time of transferring is removed by the cleaning device 10 to be used for the next image forming.

Transfer material P fed into the fixing device 11 is heated and pressurized by a fixing roller 11*a* and a pressure roller 11*b* to fix the toner image on the surface. Transfer material P in which, on one surface (first surface), image forming has been completed is discharged onto the sheet-discharge tray 13. Thus, four-full-color image forming on one surface of transfer material P is completed.

On the other hand, image forming on both the surfaces (the first surface, and the second surface opposite side of the first surface) of transfer material P may be performed as described below. Transfer material P having the toner image fixed on its first surface is supplied to an automatic double-side feeding unit (not shown) to be turned upside down, and is again attracted and attached to the surface of the transferring belt 1. To the second surface of transfer material P, toner images in the respective colors are transferred by the image forming stations SM, SC, SY, and SK and are fixed by the fixing device 11, as are those transferred to the first surface. Transfer material P is thereafter discharged onto the sheet-discharge tray 13. Thus, four-full-color image forming on the two surfaces of transfer material P is completed.

The above-described transferring belt 1 has its resistivity adjusted in such a manner that an ion conductive agent is added to polyvinylidene fluoride (PVdF) resin so that the volume resistivity is $1\times10^9$ Ω·cm. The transferring belt 1 is formed in a single layer structure having a thickness of 100 μm. The volume resistivity according to the present invention is set by normalizing with respect to the belt thickness a measured value obtained by using a measuring probe in accordance with JIS method K6911 and applying voltage of 100 V with a high-resistance meter, R8340 manufactured by ADVANTEST Corporation.

From the viewpoint of electrostatically attracting transfer material P, it is desirable that the volume resistivity of the transferring belt 1 be high. However, if the volume resistivity is excessively high, the transferring belt 1 itself is charged up and a need for a high transferring voltage (transferring bias) arises as well as a need for an additional mechanism for eliminating charge on the transferring belt 1. In setting the resistivities of the transferring parts to a high value according to various requirements, therefore, it is desirable to set the volume resistivity of the transfer member, i.e., the transferring roller 4, within a suitable range instead of unnecessarily increasing the resistivity of the transferring belt 1 as the transferring and conveying member. More specifically, if the transferring belt 1 has a volume resistivity equal to or higher than $1\times10^{12}$ Ω·cm, potential attenuation in the transferring belt 1 during movement between each pair of image forming stations, i.e., self-attenuation, cannot be expected. In such a case, a need arises to use means for eliminating charge on the transferring belt 1, e.g., a corona charger. Therefore this setting is considered undesirable from the viewpoint of simplifying the apparatus and reducing the manufacturing cost. The transferring roller 4 can be increased in thickness of the resistance layer unlike the transferring belt 1. Even if a material having a lower volume resistivity is used for the transferring roller 4, the resistivity thereof as the transfer member can be set to a high value and a high-resistance system can be constructed while avoiding charge-up. In this embodiment, by considering achievement of self-attenuation in the transferring belt 1 and realization of the transferring belt 1 with a sufficiently high attraction for transfer material P, the resistance of the transferring belt 1 is set to the above-mentioned value ($1\times10^9$ Ω·cm).

Figure 6A:
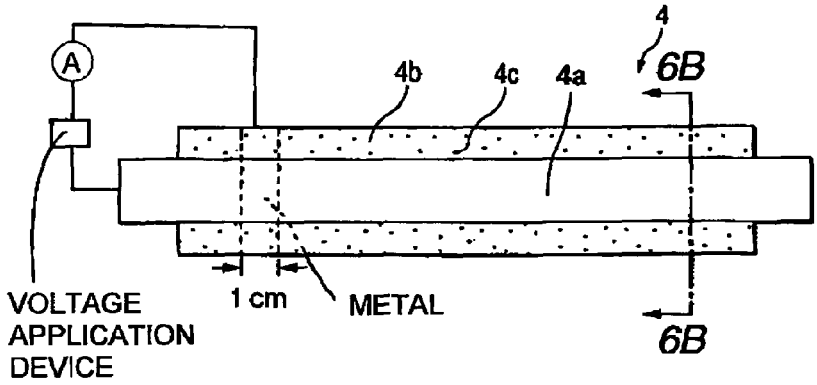
FIG. 6A is a longitudinal sectional view of a transferring roller in accordance with a first embodiment of the present invention.
Figure 6B:
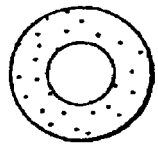
FIG. 6B is a cross-sectional view of the transferring roller shown in FIG. 6A.

The construction of the transferring roller 4 used in this embodiment will be described in detail with reference to FIGS. 6A and 6B.

The transferring roller 4 has an elastic layer 4*b* which is formed on the metal core 4*a* as an ionic conductor part. A single-layer roller having a metal core diameter of 6 mm and an outer diameter of 12 mm was used as the transferring roller 4. That is, the ionic conductor part is a surface layer. The elastic layer of the roller is prepared by mixing epichlorohydrin rubber with nitrile-butadiene rubber (NBR) and blending a diphenylamine-based antioxidant 4*c* therein. The resultant is formed by extrusion molding and polished. The voltage dependence of the roller resistivity is limited because of the ion-conductive property. The roller resistivity in the case where a strip of metallic foil having a width of 1 cm is wrapped around the outer peripheral surface of the roller is $5.5\times10^6$ Ω when a voltage of 250 V is applied between the surface and the metal core, and $4\times10^6$ Ω when a voltage of 1000 V is applied.

As described above, in the transfer devices in an in-line system image forming apparatus, the transfer material P and the transferring belt 1 are charged up at an image forming station at a downstream position by transferring charge supplied from an image forming station at an upstream position, so that the transferring voltage applied from the image forming station closer to the downstream end must be set to higher value in order to cause the same transferring current to flow. Therefore, in the transfer devices in such conventional in-line system image forming apparatuses, a condition may occur easily such that the transferring voltage is abnormally high and the transferring efficiency is liable to become lower due to abnormal discharge. Such a phenomenon is particularly considerable at the time of double-sided image forming or image forming on an OHT sheet requiring a higher transferring voltage.

For example, while the transferring voltage at the time of double-sided image forming in an intermediate transfer type of image forming apparatus ordinarily used is about 2 kV, the necessary condition for double-sided image forming in a transferring belt-type of image forming apparatus is a transferring voltage of 3 kV at the final image forming station SM for the fourth color, even though the sufficient transferring voltage at the image forming station SM for the first color is 2 kV. This means that the transfer material P and the transferring belt 1 are charged up by 1 kV.

Figure 2:
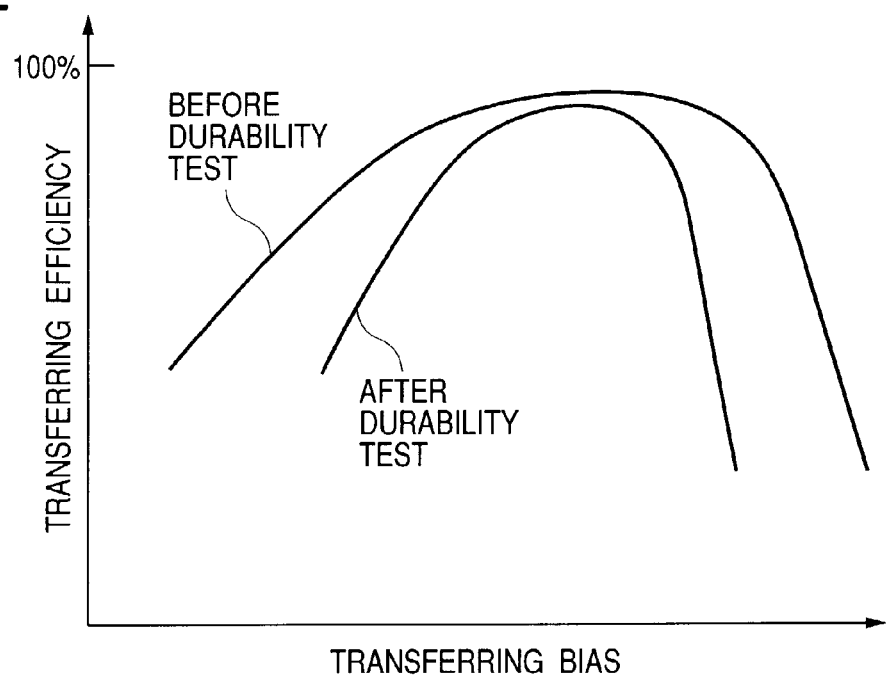
FIG. 2 is a diagram showing a relationship between a transferring bias and transferring efficiency in a conventional ionic conductor type of transferring roller measured before and after a durability test.
Figure 3:
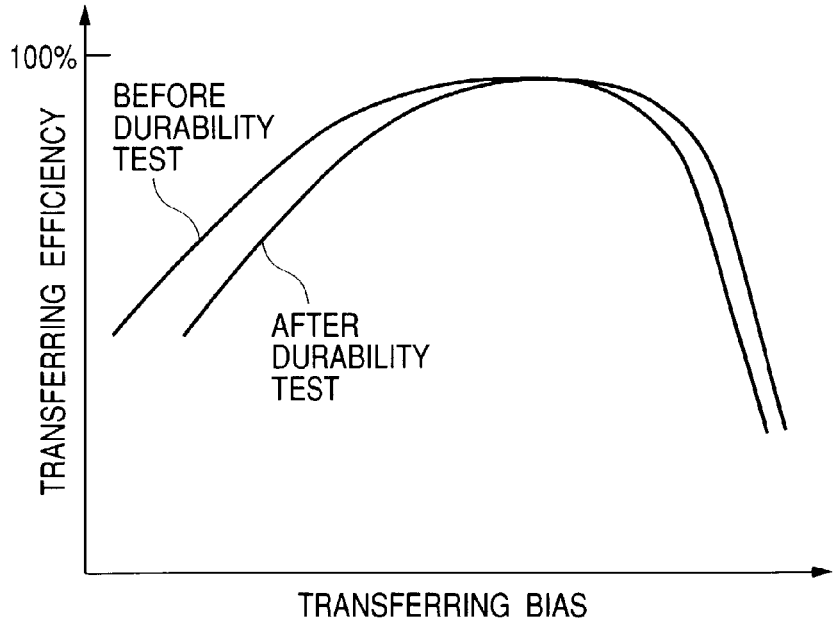
FIG. 3 is a diagram showing a relationship between a transferring bias and transferring efficiency in an ionic conductor type of transferring roller in accordance with the present invention measured before and after a durability test.
Figure 4:
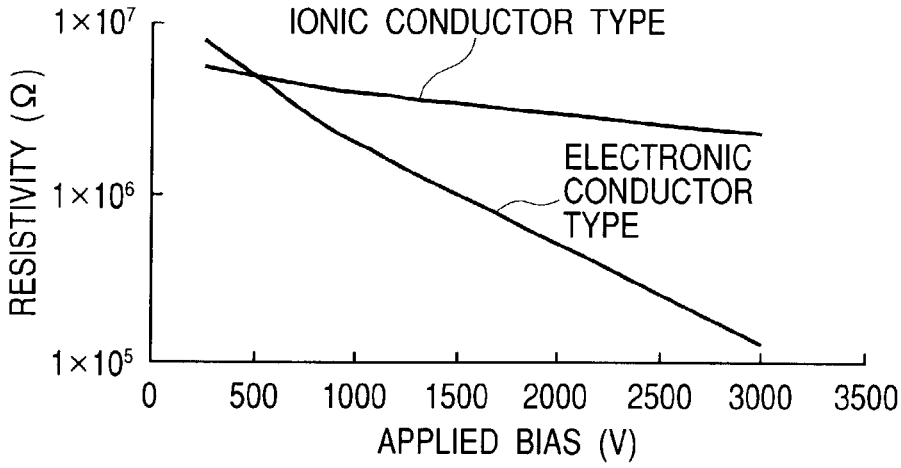
FIG. 4 is a diagram showing a relationship between an applied bias and a resistivity with respect to an ionic conductor type of transferring roller and an electronic conductor type of transferring roller.
Figure 5:
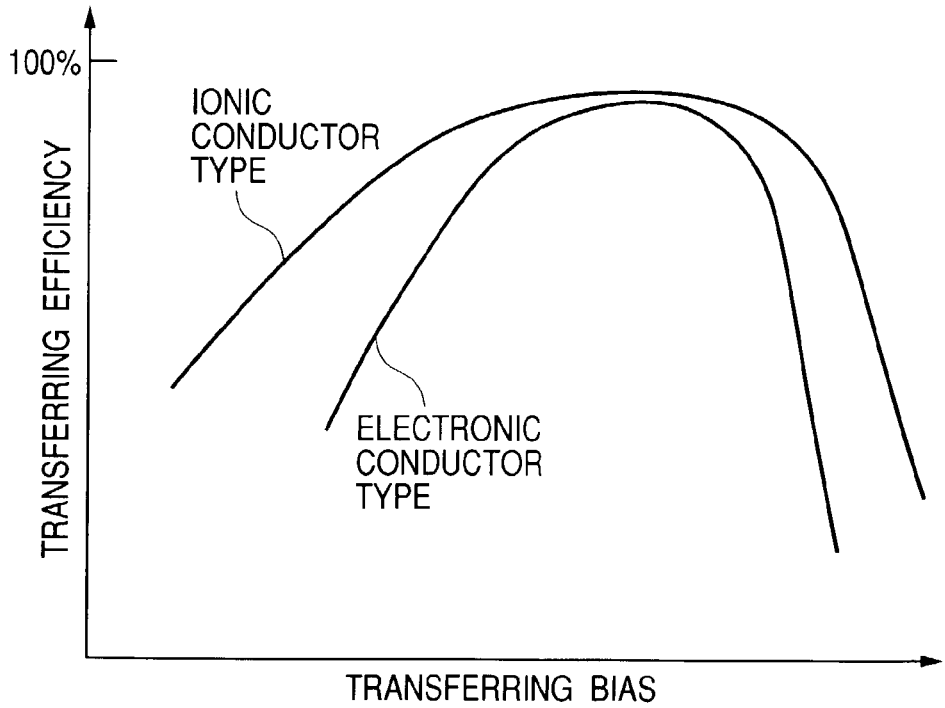
FIG. 5 is a diagram showing the relationship between the transferring bias and the transferring efficiency in the ionic conductor type of transferring roller and the electronic conductor type of transferring roller.

FIG. 2 shows the transferring efficiency when a conventional transferring roller formed without blending an antioxidant therein is used. It can be understood from FIG. 2 that the region in which the transferring efficiency is sufficiently high is reduced after a durability test. FIG. 3 shows the transferring efficiency when the transferring roller 4 of this embodiment formed by blending an antioxidant therein is used. The optimum transferring bias point is slightly shifted in the direction of increase in voltage as a result of the endurance test, but the region in which a sufficiently high transferring efficiency can be obtained is substantially the same as that before the durability test.

Also, in the transferring roller formed without blending an antioxidant therein, an increase in resistivity of about ten times as a result of the durability test was observed in the range from 250 to 3000 V ordinarily set as a transferring bias range. In contrast, in the case of the transferring roller 4 formed by blending an antioxidant therein, the increase in resistance was limited to about $10^{2/5}$Ω. It is preferable to limit the change in resistance to $10^{1/2}\Omega$ or less. Also, it is preferred that the difference between the resistivity of the transferring roller when a voltage of 1000 V is applied and the resistivity of the transferring roller when a voltage of 250 V is applied does not exceed $10^{1/5}\Omega$.

To limit the inflow of transferring current to the paper passing portion and the non-paper-passing portion, it is necessary to reduce the impedance of the non-paper-passing portion as seen from the transfer member. Accordingly, it is necessary to set the resistivity of the transfer member to a certain level or higher.

In a case where an electron-conductive transfer member is used, a reduction in resistivity occurs in a high-voltage range and there is therefore a need to set the resistance of the member to a value approximately equal to or larger than $10^8$ Ω. In contrast, in a case where an ion-conductive transfer member is used, the reduction in resistivity in the high-voltage range is small and the change in resistance during a durability test is also small. In this case, therefore, it is desirable to set the resistance of the transfer member to a value equal to or higher than $10^6$ Ω.

Also, to cause a current necessary for transfer (e.g., about 10 μA) to flow by using a practical high-voltage power supply (having a maximum voltage of 10 kV, for example), it is desirable to limit the resistance of the transfer member to a value of $10^9$ Ω or less.

Accordingly, it is preferred that the resistance of the transfer member when a voltage of 1000 V is applied be $1\times10^6$ to $1\times10^9$ Ω.

As described above, in the in-line system image forming apparatus using the transferring belt 1 in this embodiment, an ion-conductive transferring roller formed by blending an antioxidant therein is used for the purpose of preventing occurrence of an image defect at the time of double-sided image forming requiring a particularly high transferring voltage, and use of this transferring roller provides a large effect.

Second Embodiment

In this embodiment, in a case of an in-line system image forming apparatus using a transferring belt, an ion-conductive transfer member having a surface not smooth, e.g., a surface in sponge form is used to prevent occurrence of an image defect when a high transferring voltage is applied. Also, an antioxidant is blended in the material forming the transfer member to enable the desired performance to be maintained during a durability test. The construction of the image forming apparatus of this embodiment is the same as that of Embodiment 1 (shown in FIG. 1). The image forming apparatus of this embodiment has an OHT mode which is selected when image forming is performed on an OHT sheet.

As described above in the description of Embodiment 1, in a system using the transferring belt 1 in an in-line system image forming apparatus, there is a need to set the transferring voltage from an image forming station at a downstream position to a higher value because of charge-up in the transfer material P and the transferring belt 1, and there is a problem in that image defects can occur easily.

The maximum voltage at the time of double-sided image forming is about 3 kV even in the case of a transferring belt type of image forming apparatus. Under such a condition, it is possible to prevent occurrence of image defects during a durability test by using an ion-conductive transfer member formed by blending an antioxidant.

In some case of image forming on an OHT sheet which is substantially insulating in the thickness direction, the necessary transferring voltage for transfer to the OHT sheet reaches 6 kV.

As a means for preventing an image defect due to separation discharge, a resistivity treatment is ordinarily performed on the surface of OHT sheets. However, the base film of ordinary OHT sheets is an insulating material such as polyethylene telephthalate (PET) and the thickness thereof is 100 μm or more. Therefore, the voltage necessary for transfer is high and charge-up is considerable. Therefore, the downstream-side image forming stations must be operated under severe conditions with respect to the transferring voltage and occurrence of image defects.

Figure 7A:
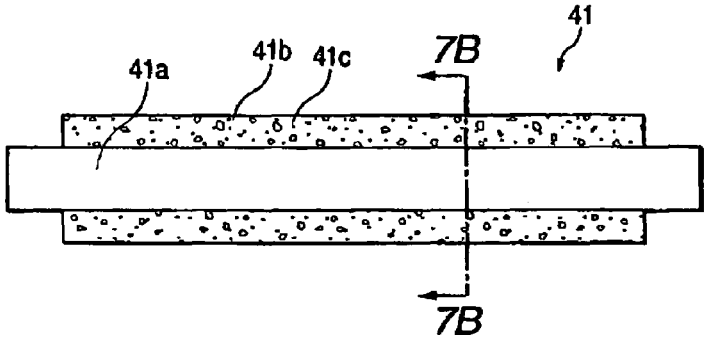
FIG. 7A is a longitudinal sectional view of a transferring roller in accordance with a second embodiment of the present invention.
Figure 7B:
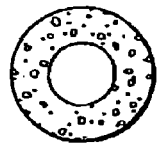
FIG. 7B is a cross-sectional view of the transferring roller shown in FIG. 7A.

In this embodiment, an ion-conductive sponge roller 41 such as shown in FIGS. 7A and 7B constituted by a material with which an antioxidant 41*c* is blended is used as transferring roller (transfer member) 4 to prevent occurrence of image defects at the time of image forming on an OHT sheet.

If the surface of the transferring roller 4 is smooth, the threshold value at which discharge starts between the transferring roller 4 and the back surface (reverse surface) of the transferring belt 1 is high. This is because the discharge start voltage (discharge threshold value) depends only upon air pressure and the intensity of the electric field therebetween, as explained in discharge theories including Pachen's law. Since the electric field between parallel electrodes is a parallel electric field (uniform electric field), the threshold value of discharge between the two members is maximized.

In a separation step including rotating and moving the transferring roller 4 and the transferring belt 1, the voltage across the gap becomes extremely high, so that discharge is necessarily excited at an ordinary transferring voltage regardless of the discharge threshold value.

When discharge occurs under a high-discharge-threshold value condition as between smooth parallel surfaces, the amount of charge moved by one discharge is extremely large. In such an event, charge balance on at the back surface of the transfer material P can be easily lost and a large discharge shock is caused. Therefore, when an OHP sheet is used, the possibility of an image defect such as an abnormal discharge pattern typified by a zigzag discharge pattern or a dotted pattern due to nonuniformity of back charge on the sheet is high.

On the other hand, the transferring roller 41 having a sponge-like surface has extremely small irregularities in its surface, which cause a non-uniform electric field to reduce the discharge threshold value and to reduce the extent of movement of charge per discharge.

That is, charge transfer is effected even by many minute discharges, so that a large discharge which may lead to occurrence of an image defect can be prevented without changing the transferring current.

In this embodiment, a sponge-like elastic layer 41*b* provided as an ionic conductor part on a metal core 41*a* is used. More specifically, an ion-conductive sponge roller was used which was made in such a manner that a diphenylamine antioxidant 41*c* is blended with a mixture of NBR and epichlorohydrin rubber, a cylindrical tube is formed by extrusion molding from this material, and this tube is vulcanized and foamed in a pressured atmosphere. In this manner, a sponge roller having a metal core diameter of 6 mm, an outside diameter of 12 mm, a product hardness Asker C of 30° with respect to a load of 500 g, an actual resistance of $1\times10^7$ Ω measured by the above-mentioned resistance measuring method when 1000 V was applied and a sponge surface cell diameter of about 100 μm was made.

The surface roughness of this sponge roller measured with a non-contact surface roughness meter was 40 μm. Image forming on an OHT sheet was performed by using this sponge roller and operating the image forming apparatus in accordance with Embodiment 1. The operation in the OHT mode is performed by changing the transferring voltage by a command from a host computer. As a comparative example, image forming using an electron-conductive solid roller was performed by setting transferring voltages of 2 kV, 3.5 kV, 5.0 kV, and 6.5 kV in at image forming stations successively from the upstream side. In this case, considerable image scatter and paper traces in the non-paper-passing portion were caused.

Image forming using the ion-conductive sponge roller of this embodiment was performed under the same conditions to continuously output a good image during a durability test.

As described above, in the case of transfer at a high voltage such as image forming with respect to the OHC sheet, the transfer member in a sponge form or the like which is ion-conductive and having a non-smooth surface structure is used to prevent an image defect on an OHT sheet, e.g., an abnormal discharge pattern such as a zigzag discharge pattern or a dotted pattern due to abnormal discharge, thereby limiting excessive discharge while causing many small discharges to move transferring charge. Thus, the present invention has the effect of preventing occurrence of image defects. Also, blending of an antioxidant is effective in maintaining the improved performance during a durability test.

Figure 8:
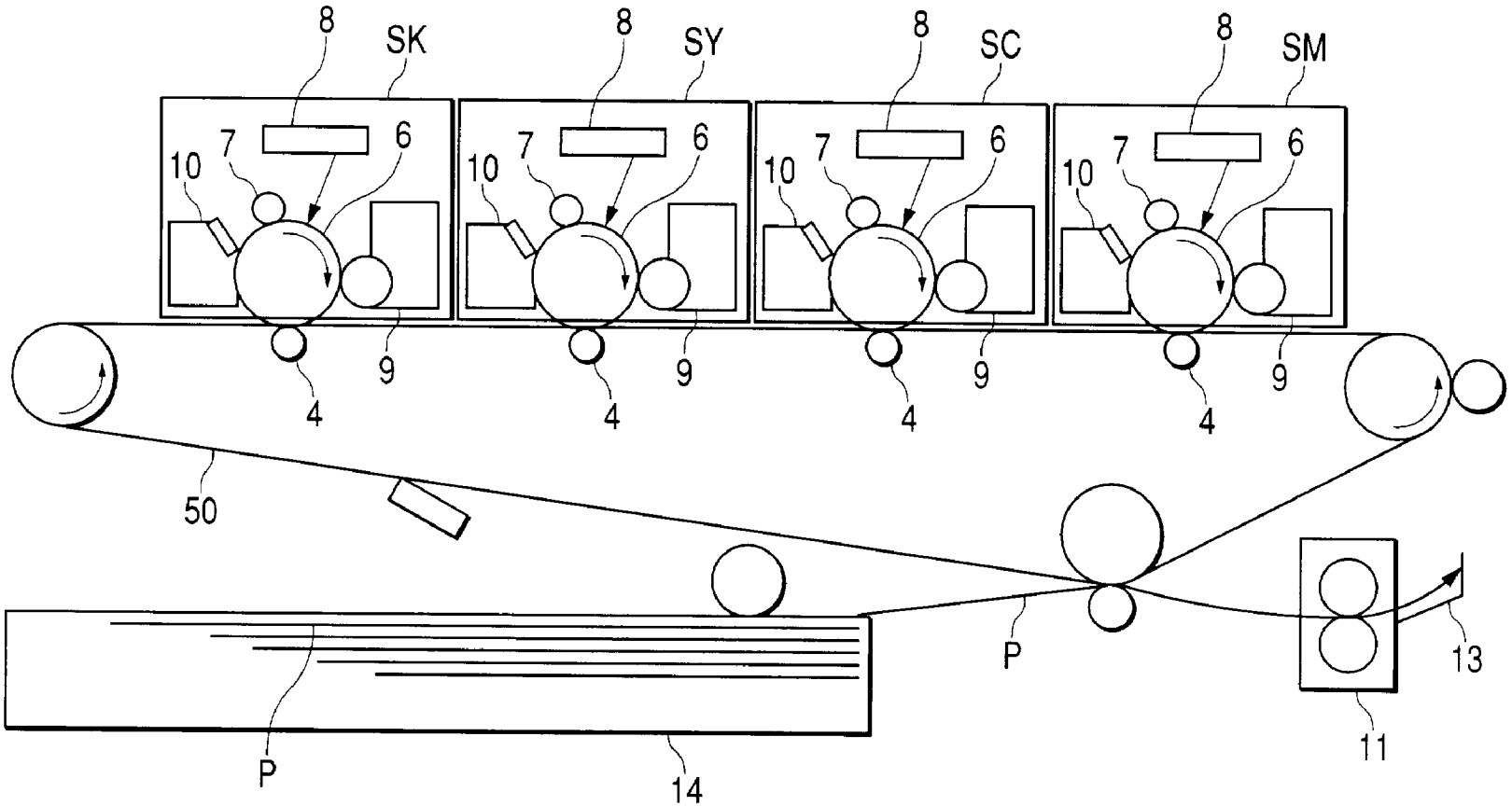
FIG. 8 is a diagram showing another image forming apparatus to which the present invention can be applied.
Figure 9:
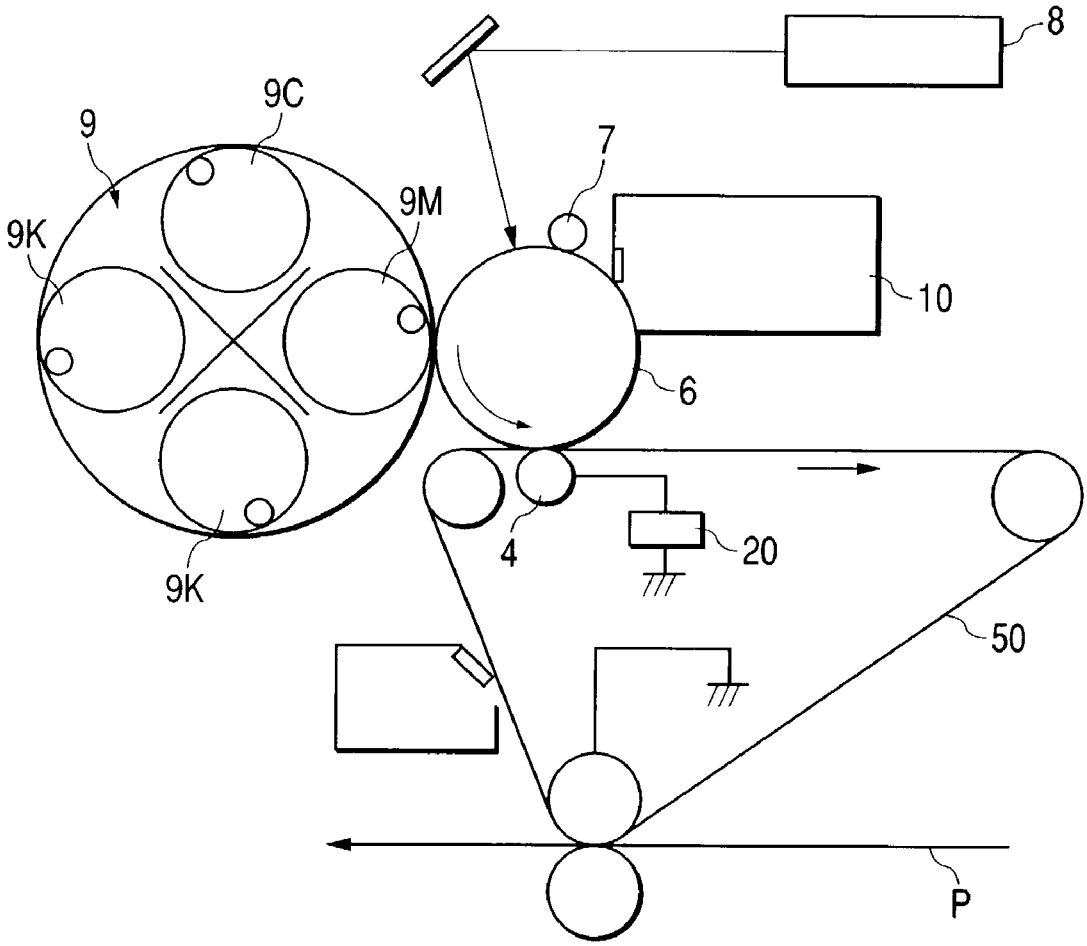
FIG. 9 is a diagram showing another image forming apparatus to which the present invention can be applied.

The embodiments of the present invention have been described by way of example with respect to an in-line four-full-color image forming apparatus (laser printer) which uses a transferring belt, and which is particularly effective when the transfer device in accordance with the present invention is used. However, the transfer device of the present invention is not limited to this image forming apparatus. For example, it can be applied to an image forming apparatus in which an intermediate transferring body 50 (e.g., an intermediate transferring belt, or an intermediate transferring drum) such as shown in FIG. 8 is used as the other member in place of the above-described transfer material P. In this case, the transfer member is opposed to the photosensitive drum with the intermediate transferring body interposed therebetween, an image on the photosensitive drum is temporarily transferred to the intermediate transferring body and is then transferred to a transfer material. The transfer device can also be applied to an image forming apparatus such as shown in FIG. 9 in which a four-full-color image is formed on one photosensitive drum by four developing devices 9M, 9C, 9Y, and 9K, or to a monochromic image forming apparatus. Also in this case, the same effect of the present invention can be achieved.

According to the present invention, as described above, variation in resistivity of the transfer member accompanying a change in applied voltage is limited and high transferring efficiency can be maintained during a durability test, so that improved images can be obtained during a long period of time.

While the present invention has been described with respect to preferred embodiments thereof, the present invention is not limited to the described embodiments and the described embodiments can be modified variously within the technical scope of the invention.

What is claimed is:

1. An image forming apparatus comprising:

an image bearing member; and a transfer roller including a metal core, wherein an image on said image bearing member is transferred to a member to be transferred by applying a voltage to said transfer roller, and wherein said transfer roller includes an ionic conductor part contains an antioxidant, wherein, in a condition that a metal strip having a width of 1 cm. is wound on an outer circumference of said transfer roller and a voltage from 250 V to 3000 V is applied between said metal core and said metal strip, a change in resistance of said transfer roller is less than or equal to $10^{1/2}$ Ω.

2. An image forming apparatus according to claim 1, wherein, in a condition that said metal strip is wound on an outer circumference of said transfer roller and a voltage of 1000 V is applied between said metal core and said metal strip, a resistance of said transfer roller is in a range of $1\times10^{6}$ to $1\times10^{9}$ Ω.

3. An image forming apparatus according to claim 1, wherein a change in resistance of said transfer roller when a voltage of 1000 V is applied between said metal core and said metal strip and when a voltage of 250 V is applied between said metal core and said metal strip is less than or equal to $10^{1/5}$ Ω.

4. An image forming apparatus according to claim 1, wherein said ionic conductor part is in a sponge form.

5. An image forming apparatus according to claim 1, wherein a surface roughness of said ionic conductor part on said image bearing member side is 10 μm or more.

6. An image forming apparatus according to claim 1, wherein said ionic conductor part is formed on said metal core.

7. An image forming apparatus according to claim 1, wherein said ionic conductor part comprises an elastic layer.

8. An image forming apparatus according to claim 1, wherein said ionic conductor part comprises a surface layer.

9. An image forming apparatus according to claim 1, wherein the member to be transferred comprises a transfer material.

10. An image forming apparatus according to claim 9, further comprising a conveyance member for bearing and conveying the transfer material, said transfer roller facing said image bearing member with said conveyance member interposed therebetween.

11. An image forming apparatus according to claim 10, wherein said conveyance member is ion-conductive.

12. An image forming apparatus according to claim 1, wherein the member to be transferred comprises an intermediate transferring body, and an image on said image bearing member is temporarily transferred to the intermediate transferring body and is then transferred to a transfer material.

13. An image forming apparatus according to claim 12, wherein the transfer member faces said image bearing member with the intermediate transferring body interposed therebetween.

14. An image forming apparatus according to claim 1, further comprising a plurality of image bearing members and a plurality of transfer rollers corresponding to a plurality of different colors, and images on said plurality of said image bearing members are successively transferred to the member to be transferred by said plurality of said transfer rollers.

15. A transfer apparatus comprising:

a transfer roller including a metal core; and a voltage applying means, wherein said voltage applying means applies a voltage to said transfer roller and an image is transferred to a member to be transferred, and wherein said transfer roller includes an ionic conductor part which contains an antioxidant, and wherein, in a condition that a metal strip having a width of 1 cm. is wound on an outer circumference of said transfer roller and a voltage from 250 V to 3000 V is applied between said metal core and said metal strip, a change in resistance of said transfer roller is less than or equal to $10^{1/2}$ Ω.

16. A transfer apparatus according to claim 15, wherein in a condition that said metal strip is wound on an outer circumference of said transfer roller and a voltage of 1000 V is applied between said metal core and said metal strip, a resistance of said transfer member is in a range of $1\times10^{6}$ to $1\times10^{9}$ Ω.

17. A transfer apparatus according to claim 15, wherein a change in resistance of said transfer roller when a voltage of 1000 V is applied between said metal core and said metal strip and when a voltage of 250 V is applied between said metal core and said metal strip is less than or equal to $10^{1/5}$ Ω.

18. A transfer apparatus according to claim 15, wherein said ionic conductor part is in a sponge form.

19. A transfer apparatus according to claim 15, wherein a surface roughness of said ionic conductor part is 10 μm or more.

20. A transfer apparatus according to claim 15, wherein said ionic conductor part is formed on said metal core.

21. A transfer apparatus according to claim 15, wherein said ionic conductor part comprises an elastic layer.

22. A transfer apparatus according to claim 15, wherein said ionic conductor part comprises a surface layer.

23. A transfer apparatus according to claim 15, wherein the member to be transferred comprises a transfer material.

24. A transfer apparatus according to claim 15, wherein the member to be transferred comprises an intermediate transferring body, and an image on an image bearing member is temporarily transferred to the intermediate transferring body and is then transferred to a transfer material.

25. A transferring roller comprising:

a metal core; and an ionic conductor part provided on said metal core, wherein said ionic conductor part contains an antioxidant, wherein, in a condition that a metal strip having a width of 1 cm. is wound on an outer circumference of said transfer roller and a voltage from 250 V to 3000 V is applied between said metal core and said metal strip, a change in resistance of said transfer roller is less than or equal to $10^{1/2}$ Ω.

26. A transferring roller according to claim 25, wherein, in a condition that said metal strip is wound on an outer circumference of said transferring roller and a voltage of 1000 V is applied between said metal core and said metal strip, a resistance resistivity of said transferring roller is in a range of $1\times10^{6}$ to $1\times10^{9}$ Ω.

27. A transferring roller according to claim 25, wherein a change in resistance of said transferring roller when a voltage of 1000 V is applied between said metal core and said metal strip and when a voltage of 250 V is applied between said metal core and said metal strip is less than or equal to $1\times10^{1/5}$ Ω.

28. A transferring roller according to claim 25, wherein said ionic conductor part is in a sponge form.

29. A transferring roller according to claim 25, wherein a surface roughness of said ionic conductor part is 10 μm or more.

30. A transferring roller according to claim 25, wherein said ionic conductor part comprises a surface layer.

* * * * *

UNITED STATES PATENT AND TRADEMARK OFFICE

CERTIFICATE OF CORRECTION

PATENT NO. : 7,020,422 B2
APPLICATION NO. : 10/280014
DATED : March 28, 2006
INVENTOR(S) : Takaaki Tsuruya et al.

It is certified that error appears in the above-identified patent and that said Letters Patent is hereby corrected as shown below:

ON THE COVER PAGE:

UNDER REFERENCES CITED, ITEM (56):

"09269679" should read --9-269679--; and
"11030897" should read --11-30897--.

COLUMN 1:

Line 24, "born" should read --borne--; and
Line 62, " "station")" should read --"stations")--.

COLUMN 3:

Line 24, "many" should read --a large amount of--;
Line 43, "potion" should read --portion--; and
Line 65, "Further" should read --Yet--.

COLUMN 4:

Line 5, "Still" should read --A still--.

COLUMN 5:

Line 63, "changing," should read --charging,--; and
Line 64, "of" should be deleted.

COLUMN 6:

Line 61, "one" should read --on one--.

COLUMN 9:

Line 2, "resistivity" should read --resistance--.

COLUMN 10:

Line 1, "case" should read --cases--; and
Line 38, "on" should be deleted.

UNITED STATES PATENT AND TRADEMARK OFFICE

CERTIFICATE OF CORRECTION

PATENT NO. : 7,020,422 B2
APPLICATION NO. : 10/280014
DATED : March 28, 2006
INVENTOR(S) : Takaaki Tsuruya et al.

It is certified that error appears in the above-identified patent and that said Letters Patent is hereby corrected as shown below:

COLUMN 11:

Line 10, "in" should be deleted.

COLUMN 12:

Line 5, "contains" should read --containing--.

COLUMN 14:

Line 20, "resistivity" should be deleted.

Signed and Sealed this

Twelfth Day of December, 2006

JON W. DUDAS
*Director of the United States Patent and Trademark Office*